US006097178A

United States Patent [19]

Owen et al.

[11] Patent Number: 6,097,178

[45] Date of Patent: Aug. 1, 2000

[54] CIRCUITS AND METHODS FOR MULTIPLE-INPUT, SINGLE-OUTPUT, LOW-DROPOUT VOLTAGE REGULATORS

[75] Inventors: Richard Todd Owen, Fremont; Dennis O'Neill, Monte Sereno, both of Calif.

[73] Assignee: Linear Technology Corporation, Milpitas, Calif.

[21] Appl. No.: 09/152,860

[22] Filed: Sep. 14, 1998

[51] Int. Cl.[7] ..... G05F 1/44

[52] U.S. Cl. ..... 323/273

[58] Field of Search ..... 323/265, 273, 323/274, 275, 276; 307/64–66

[56] References Cited

U.S. PATENT DOCUMENTS

| | | | |
|---|---|---|---|
| 4,779,037 | 10/1988 | Locascio | 323/275 |
| 5,465,011 | 11/1995 | Miller et al. | 307/64 |
| 5,539,603 | 7/1996 | Bingham | 361/56 |
| 5,847,550 | 12/1998 | Schie et al. | 323/222 |

*Primary Examiner*—Adolf Deneke Berhane
*Attorney, Agent, or Firm*—Fish & Neave; Robert W. Morris; Mathew T. Byrne

[57] ABSTRACT

The circuits and methods of the present invention provide multiple-input, single-output, low-dropout voltage regulators that use at least two output stages to drive an output terminal that may be connected to an output load. An error amplifier may also be used to regulate the voltage provided by these output stages to the output terminal. In one embodiment, this error amplifier also is used in conjunction with detection and control circuitry to select the output stage or stages providing power to the output terminal. In other embodiments, only the detection and control circuitry is used to select the output stage or stages providing power to the output terminal. The regulators allow power to be provided by a primary power source regardless of the primary power source's voltage relative to other power sources by measuring the voltage provided at the output terminal or by detecting dropout in an output stage, rather than by comparing the voltages provided by the power sources.

59 Claims, 3 Drawing Sheets

CIRCUITS AND METHODS FOR MULTIPLE-INPUT, SINGLE-OUTPUT, LOW-DROPOUT VOLTAGE REGULATORS

BACKGROUND OF THE INVENTION

This invention relates to voltage regulators. More particularly, this invention relates to circuits and methods for providing multiple-input, single-output, low-dropout voltage regulators.

Multiple-input, single-output voltage regulators are widely used in applications such as uninterruptible power supplies where multiple input sources are used to provide continuous power to an associated circuit or device. These multiple input sources may be provided by utility-supplied DC voltage supplies, generators, or batteries, for example. In a typical uninterruptible power supply application, a multiple-input, single-output voltage regulator is connected to a utility-supplied DC voltage supply as a primary source of power and a battery as a secondary source of power. In other typical uninterruptible power supply applications, multiple-input, single-output voltage regulators are connected to one battery as a primary source of power and another battery as a secondary source of power. In all of these installations, when the primary source of power becomes inadequate or non-existent, the multiple-input, single-output voltage regulator detects this inadequacy and draws power from the secondary source of power instead of or in addition to the primary source of power.

In order to provide the maximum duration over which power can be supplied by uninterruptible power supplies that operate partially or entirely off battery power, many of these supplies incorporate low-dropout voltage regulators. The dropout voltage of a voltage regulator is the minimum additional voltage that must be provided at a voltage regulator's voltage supply input to maintain a regulated output voltage. Once this additional dropout voltage is not provided, the voltage regulator ceases to provide a regulated output and, thus, is said to enter "dropout." For example, a voltage regulator may only be able to provide a regulated output voltage of ten volts if it is supplied with an input voltage of at least twelve volts. In this example, the dropout voltage of the regulator is two volts. Because the voltage of a battery drops over time as its power is drawn, regulators that have smaller dropout voltages tend to provide regulated power over a longer time period than regulators having larger dropout voltages, and, accordingly, using low-dropout voltage regulators in uninterruptible power supplies is desirable.

In a known circuit for a multiple-input, single-output voltage regulator, multiple diodes (one diode for each input of the multiple-input, single-output voltage regulator) and a single-input voltage regulator are arranged so that all of the cathodes of the diodes are connected together and to the input of the single-input voltage regulator. In this circuit, the anode of each diode is connected to the positive terminal of a different power source and the output of the single-input voltage regulator is connected to the load receiving power from the multiple-input, single-output voltage regulator. The diodes in this circuit steer current from the power sources to the input of the single-input voltage regulator such that current from the source with the highest voltage will supply power to the load. The diodes in series with the sources not having the highest voltage will be reversed biased, and, accordingly, will conduct no current.

This approach to providing a multiple-input, single-output voltage regulator is problematic in at least two regards. First, the voltage of the primary power source must always be greater than the voltages of the remaining power sources in order for the primary power source to continue providing current to the load. If at any point, the voltage of any of the remaining power sources exceeds the voltage of the primary power source, the diode associated with the primary power source will be reversed biased and will cease to provide current to the load. Second, the dropout voltage of the multiple-input, single-output voltage regulator is increased by the forward voltage of the diodes forming the inputs of the multiple-input, single-output voltage regulator. This increase in dropout voltage is undesirable because it decreases the effective duration over which a battery providing power to the multiple-input, single-output voltage regulator can do so without the regulator entering dropout.

In another known circuit for a multiple-input, single-output voltage regulator, multiple single-input voltage regulators are arranged in parallel so that the input from each regulator is connected to a different power source and so that the outputs from all of the single-input voltage regulators are connected together and to a load. In this arrangement, the output voltage of each single-input regulator must be set so that the single-input voltage regulator associated with the primary power source has the highest output voltage, the single-input voltage regulator associated with the secondary power source has the second highest output voltage, the single-input regulator associated with the tertiary power source has the third highest output voltage, and so on. By having a higher output voltage than each of the remaining power sources, the single-input voltage regulator associated with the primary power source will cause the outputs of each of the remaining regulators to be pulled above their normal operating points, thus causing them to turn off. However, once the voltage of the primary power source decreases to the point whereat the associated single-input voltage regulator enters dropout, the secondary power source by way of its associated single input voltage regulator will begin providing power to the load. As the voltage of each remaining power source decreases to the point whereat the associated single-input voltage regulator enters dropout, the next remaining power source by way of its associated single-input voltage regulator will begin providing power to the load.

This second approach to providing a multiple-input, single-output voltage regulator is also problematic in at least one regard. Particularly, due to the tolerances of the output voltages of typical single-input voltage regulators, the difference in the output voltages of any two single-output voltage regulators in this approach must be at least twice the output voltage tolerance for any single voltage regulator. This minimum required difference in output voltage causes the voltage output by a multiple-input, single-out voltage regulator implementing this approach to be susceptible to a large voltage drop when transitioning from regulation by one single-input regulator to regulation by another single-input regulator. For example, in a two single-input voltage regulator implementation of this approach, where each regulator has an output voltage tolerance of four percent, the output voltages of the two regulators would have to be separated by at least eight percent. When switching from primary regulation to secondary regulation, and thus from primary power to secondary power, the output voltage of the circuit may drop by up to eight percent. Such a large voltage change may be unacceptable for many loads.

SUMMARY OF THE INVENTION

In view of the foregoing, it is an object of the invention to provide circuits and methods for providing multiple-input, single-output, low-dropout voltage regulators.

It is also an object of the invention to provide circuits and methods for providing multiple-input, single-output, low-dropout voltage regulators that can provide power from a primary power source to a load even when voltage provided by the primary power source is less than that provided by a secondary power source.

It is a further object of the invention to provide circuits and methods for providing multiple-input, single-output, low-dropout regulators that have low dropout voltages.

It is a still further object of the invention to provide circuits and methods for providing multiple-input, single-output, low-dropout regulators that do not have a large output voltage drop when transitioning between sources of input power.

In accordance with the present invention, the above and other objects of the invention are accomplished by circuits and methods that provide multiple-input, single-output, low-dropout voltage regulators. More particularly, the circuits and methods of the present invention provide multiple-input, single-output, low-dropout voltage regulators that allow power to be supplied by a primary power source regardless of the primary power source's voltage relative to other power sources, that have low-dropout voltages, and that do not have a large voltage drop when switching between sources of power.

The multiple-input, single-output, low-dropout voltage regulators of the present invention use at least two output stages to drive an output terminal that may be connected to an output load. An error amplifier is preferably used to regulate the voltage provided by these output stages to the output terminal. In one embodiment, this error amplifier is also used in conjunction with detection and control circuitry to select the output stage or stages providing power to the output terminal. In other embodiments, only the detection and control circuitry is used to select the output stage or stages providing power to the output terminal.

The regulators of the present invention allow power to be provided by a primary power source regardless of the primary power source's voltage relative to other power sources by measuring the voltage provided at the output terminal or by detecting dropout in an output stage, rather than by comparing the voltages provided by the power sources. The regulators of the present invention have low-dropout voltages because preferably only a single power output stage connects each power source to the output terminal, and preferably each power output stage has a low dropout voltage. The regulators of the present invention do not necessarily experience large voltage drops when switching between sources of power because a large drop in output voltage is not necessary to cause a power source transition and is not the result of a power source transition.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

In accordance with the present invention, circuits and methods for providing multiple-input, single-output, low-dropout voltage regulators are disclosed.

Prior Art

Figure 1:
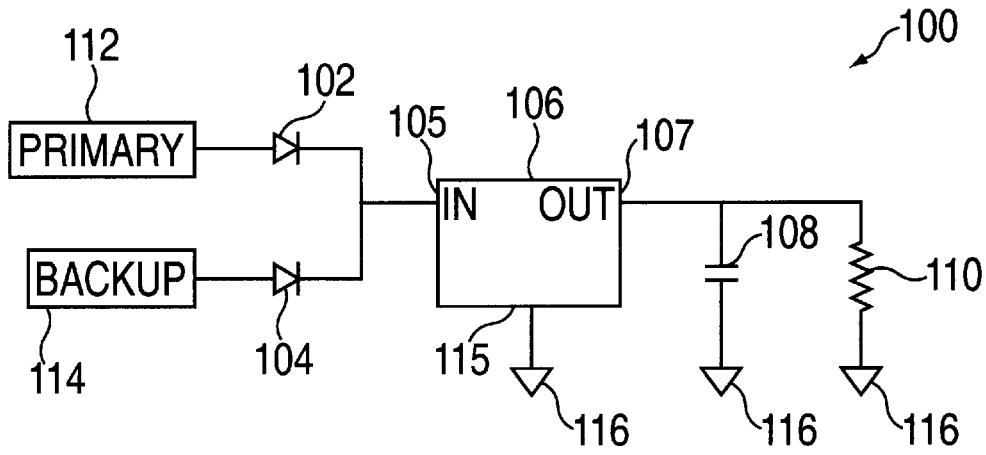
FIG. 1 (PRIOR ART)
FIG. 1 is a schematic diagram of a known multiple-input, single-output voltage regulator formed from two diodes and a single-input voltage regulator.

Referring to FIG. 1, a known multiple-input, single-output voltage regulator circuit 100 is illustrated. As shown, circuit 100 is formed from first diode 102, second diode 104, single-input voltage regulator 106, load capacitor 108, and load resistor 110. First diode 102 is arranged such that its anode is connected to primary power source 112 and its cathode is connected to input terminal 105 of single-input voltage regulator 106. Second diode 104 is arranged such that its anode is connected to backup power source 114 and its cathode also is connected to input terminal 105 of single-input voltage regulator 106. Single-input voltage regulator 106 is connected to ground 116 via ground terminal 115, and to load capacitor 108 and load resistor 110 (both of which are connected to ground 116) at output terminal 107.

The connections of diodes 102 and 104 to power sources 112 and 114, respectively, and to input terminal 105 provide a steering function in circuit 100 that causes one of diodes 102 and 104 to be reverse biased and the other to provide power to input terminal 105. For example, when primary power source 112 provides a voltage that exceeds the voltage provided by backup power source 114, diode 104 is reversed biased and only diode 102 allows power from primary power source 112 to pass through to single-input voltage regulator 106. Alternatively, when backup power source 114 provides a voltage that exceeds the voltage provided by primary power source 112, diode 102 is reversed biased and only diode 104 allows power from backup power source 114 to pass through to single-input voltage regulator 106.

Although this steering function of diodes 102 and 104 enables two power sources 112 and 114 to be connected to regulator 106, this steering function does not enable primary power source 112 to provide power, although adequate, to regulator 106 when the voltage at primary power source 112 is exceeded by that at backup power source 114, and vice versa. This disability may be particularly problematic when the lifespan of backup power source 114 is substantially less than that of primary power source 112 because backup power source 114 may be exhausted prematurely before primary power source 112 is exhausted, leaving circuit 100 with only a single power source to rely on.

As mentioned above, the series connection of each of diodes 102 and 104 to input terminal 105 of regulator 106 also has the undesirable effect of increasing the dropout voltage of regulator 106 by the forward voltage drop of diode 102 or 104 when it is passing current. For example, with diode 102 having a forward voltage drop of 0.7 volts and regulator 106 having a dropout voltage of 2.0 volts, the dropout voltage of circuit 100 is 2.7 volts when primary power source 112 is providing power. This 0.7 volt increase in the dropout voltage of circuit 100 over that of regulator 106 may have the effect of substantially decreasing the useful life of a primary power source 112 such as a battery.

Figure 2:
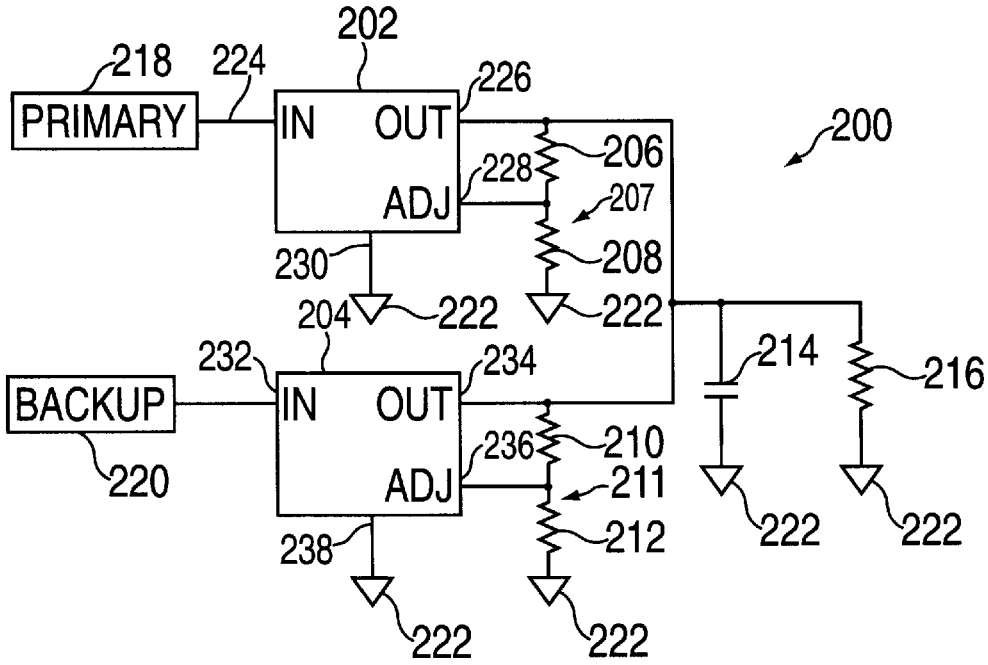
FIG. 2 (PRIOR ART)
FIG. 2 is a schematic diagram of a known multiple-input, single-output voltage regulator formed from two single-input voltage regulators.

Another known multiple-input, single-output voltage regulator circuit 200 is illustrated in FIG. 2. As shown, circuit 200 includes first single-input voltage regulator 202, second single-input voltage regulator 204, first voltage divider 207 (formed from resistors 206 and 208), second voltage divider 211 (formed from resistors 210 and 212), load capacitor 214, and load resistor 216. First regulator 202 is arranged with its input terminal 224 connected to primary power source 218, its ground terminal 230 connected to ground 222, its output terminal 226 connected to a side terminal of voltage divider 207, grounded load capacitor 214, and grounded load resistor 216, and its adjustment terminal 228 connected to a middle terminal of voltage divider 207. Second regulator 204 is arranged with its input terminal 232 connected to backup power source 220, its ground terminal 238 connected to ground 222, its output terminal 234 connected to a side terminal of voltage divider 211, grounded load capacitor 214, and grounded load resistor 216, and its adjustment terminal 236 connected to a middle terminal of voltage divider 211. Finally, as shown, the remaining side terminals of voltage dividers 207 and 211 are connected to ground 222.

Circuit 200 of FIG. 2 typically operates by regulator 202 being adjusted so that its output voltage is greater than that of regulator 204. In this configuration, the output of regulator 202 normally supplies power to load resistor 216 because output terminal 234 of regulator 204 is pulled above its normal operating point and effectively turned OFF. When regulator 202 enters dropout, regulator 204 takes over providing power to load resistor 216 because output terminal 234 is no longer pulled above its normal operating point. For example, with the output of regulator 202 set at 10.0 volts and the output of regulator 204 set at 9.0 volts, power in circuit 200 is normally provided by primary power source 218 by way of regulator 202. Because regulator 202 is outputting 10.0 volts, the output of regulator 204 is normally pulled above its 9.0 volt operating point and, therefore, is caused to be shut OFF. However, once regulator 202 enters dropout (when primary power source 218 fails, for example), backup power source 220 takes over providing power to load resistor 216 by way of regulator 204.

Because circuit 200 contains two single-input regulators 202 and 204 and no diodes that are analogous to diodes 102 and 104 of circuit 100 (FIG. 1), circuit 200 overcomes the problems with circuit 100 of FIG. 1 mentioned above. For example, because the output voltages of regulators 202 and 204 are respectively controlled by voltage dividers 207 and 211, either power source 218 or 220 may be set as normally providing power to load resistor 216, irrespective of the relative voltage of power sources 218 and 220. As another example, because circuit 200 contains no diodes that are analogous to diodes 102 and 104 of circuit 100 of FIG. 1, circuit 200 does not increase the dropout voltage of circuit 200 above that of regulators 202 and 204.

However, because of the typical output voltage tolerances associated with regulators 202 and 204, circuit 200 may suffer from a large change in output voltage across load resistor 216 when the source of power to load resistor 216 transitions between primary power source 218 and backup power source 220. Typically the output voltage tolerance of regulators 202 and 204 is on the order of four percent. In order to insure that both regulators are not simultaneously trying to supply power to load resistor 216 in light of this tolerance, it is necessary in circuit 200 to assume that the output voltage of the regulator 202 or 204 having the normally greater output voltage is going to be four percent lower than it should be and that the output voltage of the regulator 202 or 204 having the normally lesser output voltage is going to be four percent higher than it should be (i.e., the worst case scenario). Thus, to prevent a possible overlap in the output voltages of regulators 202 and 204, the output voltage of one of regulators 202 and 204 must be eight percent greater than the output voltage of the other of regulators 202 and 204. Setting the voltage difference in the outputs of regulators 202 and 204 at eight percent may cause a substantial change in the voltage to load resistor 216 when there is a transition between primary power source 218 and backup power source 220.

The Invention

Figure 3:
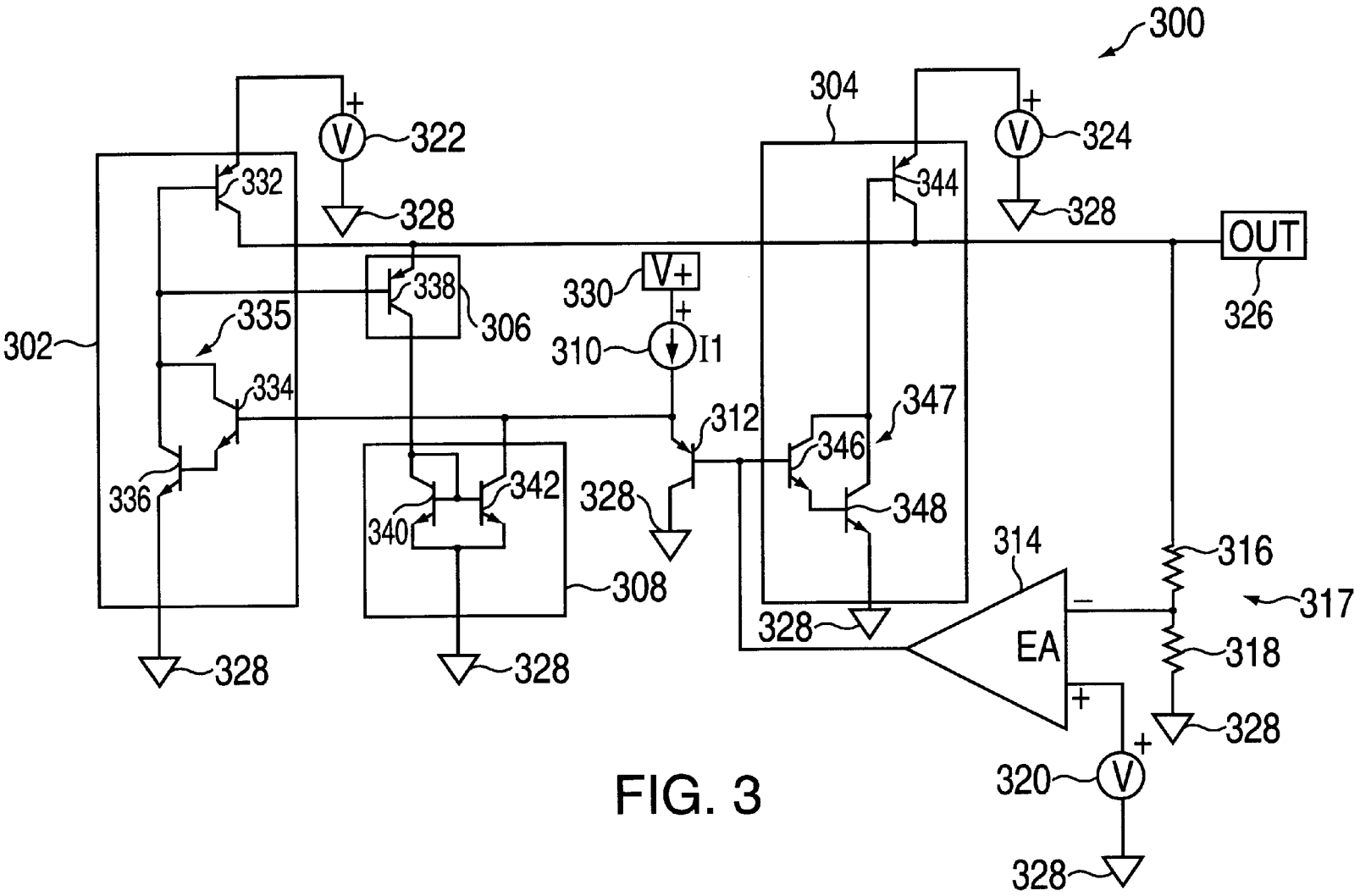
FIG. 3 is a schematic diagram of one embodiment of a multiple-input, single-output, low-dropout voltage regulator in accordance with the present invention.
Figure 4:
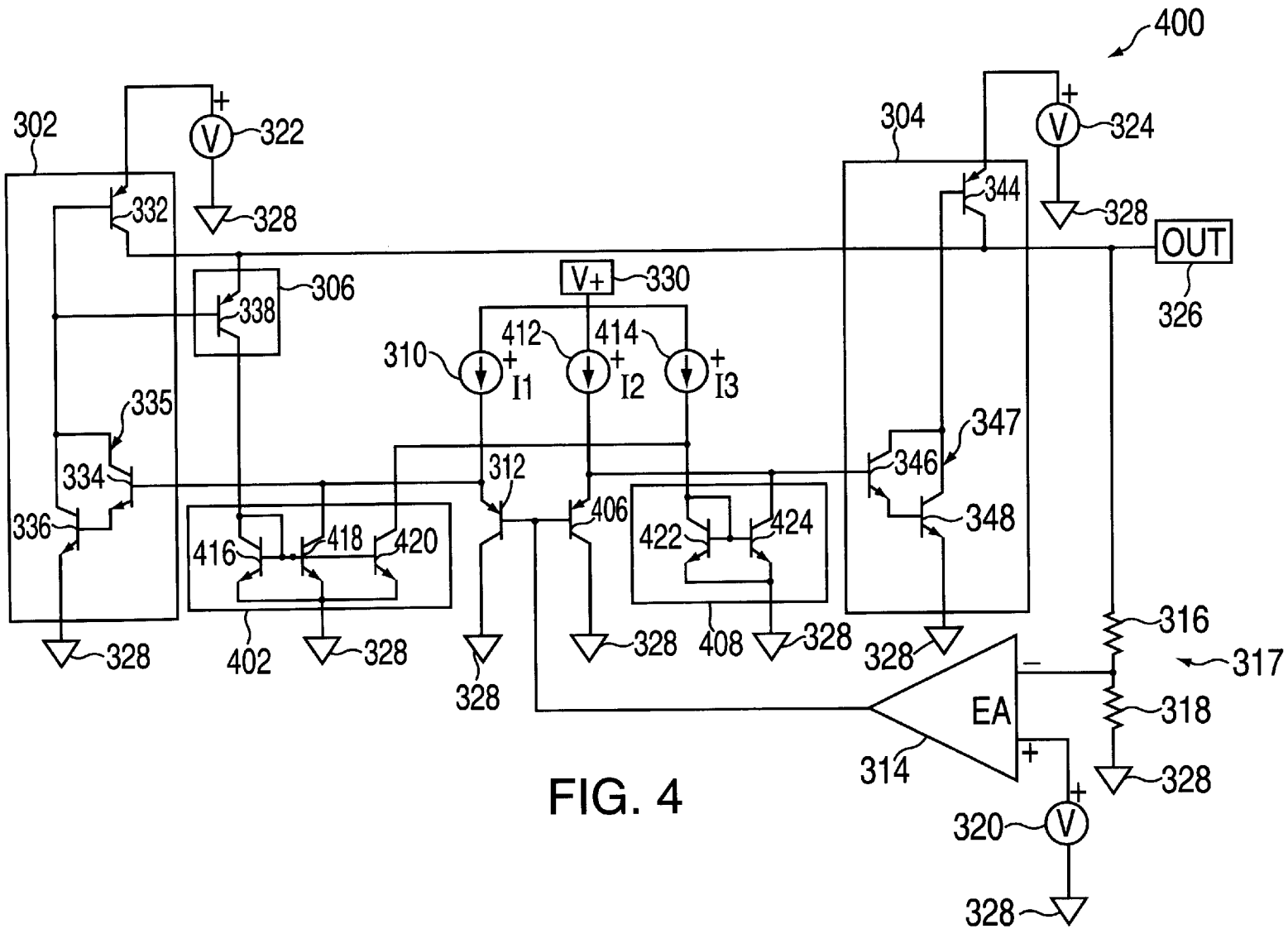
FIG. 4 is a schematic diagram of another embodiment of a multiple-input, single-output, low-dropout voltage regulator in accordance with the present invention.

In accordance with the present invention, circuits such as circuits 300 and 400, as illustrated in FIGS. 3 and 4, may be used to overcome the problems associated with circuits 100 and 200 of FIGS. 1 and 2, as well as other deficiencies in similar known circuits.

FIG. 3 shows that circuit 300 includes primary output stage 302, secondary output stage 304, saturation detection circuitry 306, primary control circuitry 308, current source 310, control transistor 312, error amplifier 314, voltage divider 317, voltage reference 320, primary power source 322, and backup power source 324.

More particularly, primary output stage 302 is preferably made up of PNP transistor 332 and a Darlington connected transistor pair 335 (which is preferably formed from NPN transistors 334 and 336). Secondary output stage 304 is preferably made up of PNP transistor 344 and a Darlington connected transistor pair 347 (which is preferably formed from NPN transistors 346 and 348). Saturation detection circuitry 306 is preferably formed from PNP transistor 338. Primary control circuitry 308 is preferably made up of NPN transistors 340 and 342 connected as a current mirror. Control transistor 312 is preferably a PNP transistor. Voltage divider 317 is preferably formed from resistors 316 and 318. And, primary power source 322 and backup power source 324 may be utility-supplied DC voltage supplies, generators, batteries, etc.

Although output stages 302 and 304, saturation detection circuitry 306, primary control circuitry 308, and control transistor 312 are illustrated as being formed from PNP transistors 332, 344, 338, and 312 and NPN transistors 334, 336, 346, 348, 340, and 342, other polarity bipolar junction transistors and other types of transistors, such as MOSFETs and CMOS devices, may be used in addition to or instead of these components.

Similarly, although error amplifier 314 is shown in circuit 300, any circuit or device capable of performing similar functions to an error amplifier may be used in circuit 300 instead of or in addition to error amplifier 314.

During operation, regulation in circuit 300 is provided by feedback loops from output terminal 326 to primary output stage 302 and secondary output stage 304. Error amplifier 314 controls how much current is diverted through control transistor 312 by controlling the voltage at the base of control transistor 312 based on the voltage at output terminal 326 with respect to voltage reference 320. By controlling how much current is diverted through control transistor 312, error amplifier 314 regulates how much of the drive current from current source 310 reaches the base of transistor 334 of Darlington connected transistor pair 335, and, accordingly, how much current is provided to output terminal 326 by primary output stage 302. More directly, the output of error amplifier 314 also controls transistor 346 of Darlington connected transistor pair 347 of secondary output stage 304 to regulate how much current is provided to output terminal 326.

The minimum voltage at the output of error amplifier 314 needed for primary output stage 302 to provide any current to output terminal 326 is equal to $V_{BE(336)}+V_{BE(334)}-V_{BE}$ (312), where $V_{BE(336)}$, $V_{BE(334)}$, and $V_{BE(312)}$ are respectively the base-to-emitter voltages of transistors 336, 334, and 312. Assuming the base-to-emitter voltages of transistors 336, 334, and 312 are the same, this minimum voltage required at the output of error amplifier 314 to turn ON primary output stage 302 may be stated more simply as one base-to-emitter voltage, or one $V_{BE}$.

The minimum voltage at the output of error amplifier 314 needed for secondary output stage 304 to provide any current to output terminal 326 is equal to $V_{BE(346)}+V_{BE(348)}$, where $V_{BE(346)}$ and $V_{BE(348)}$ are respectively the base-to-emitter voltages of transistors 346 and 348. Assuming the base-to-emitter voltages of transistors 346 and 348 are the same, the required voltage at the output of error amplifier 314 to drive secondary output stage 304 may be stated more simply as two base-to-emitter voltages, or two $V_{BE}$.

Because the minimum required voltage at the output of error amplifier 314 is one base-to-emitter voltage to drive primary output stage 302 and two base-to-emitter voltages to drive secondary output stage 304, the primary output stage 302 can be turned ON without turning ON secondary output stage 304. Moreover, because the difference between these output voltages is only one base-to-emitter voltage and the gain of error amplifier 314 is so large, only a very small voltage change is required at output terminal 326 to cause error amplifier 314 to transition from driving only primary output stage 302 to driving both primary and secondary output stages 302 and 304.

In the normal mode of operation, primary power source 322 supplies power to output terminal 326, and the output of error amplifier 314 is at approximately one base-to-emitter voltage above ground. Also in this mode, secondary output stage 304 does not deliver any power to output terminal 326 because there is not enough voltage at the base of transistor 346 to turn ON transistors 346 and 348. As long as primary power source 322 maintains a high enough output voltage so that circuit 300 provides the required load current without primary output stage 302 entering dropout, circuit 300 remains in the normal mode of operation.

However, if the output voltage of primary power source 322 drops to the point where primary output stage 302 enters dropout and, therefore, can no longer supply the required output current or if primary power source 322 is disconnected from primary output stage 302, then the output voltage at terminal 326 starts to drop. Error amplifier 314 senses this drop and its output rises to two base-to-emitter voltages where secondary output stage 304 turns ON. At this point, circuit 300 operates in a backup mode and both output stages 302 and 304 are driven ON.

In order to regulate the voltage at output terminal 326 when both output stages 302 and 304 are driven ON, saturation detection circuitry 306 and primary control circuitry 308 cause primary power source to provide as much current to the load connected to output terminal 326 as it can while maintaining primary output stage 302 at the edge of dropout as long as possible. To do so, as primary output stage 302 starts to enter dropout, saturation detection circuitry 306 starts to turn ON and pass current to primary control circuitry 308. As this current passes through the input side of the current mirror of primary control circuitry 308 formed by transistor 340, an equal or proportional current passes through transistor 342 of circuitry 308. This current passing through transistor 342 diverts current away from the base of transistor 334 and, thereby, causes primary output stage 302 to be driven less and held at the edge of dropout.

While saturation detection circuitry 306 and primary control circuitry 308 are causing primary power source to provide as much current as it can, error amplifier 314 causes secondary output stage 304 to supply the remaining current and voltage that is necessary to regulate the voltage at output terminal 326 to the desired level.

Turning now to FIG. 4, circuit 400 includes primary output stage 302, secondary output stage 304, saturation detection circuitry 306, primary control circuitry 402, current sources 310, 412, and 414, control transistor 312, secondary control transistor 406, secondary control circuitry 408, error amplifier 314, voltage divider 317, voltage reference 320, primary power source 322, and backup power source 324.

More particularly, primary output stage 302, secondary output stage 304, saturation detection circuitry 306, current source 310, control transistor 312, error amplifier 314, voltage divider 317, voltage reference 320, primary power source 322, and backup power source 324 are substantially the same as those identically named components of circuit 300 described above in connection with FIG. 3. Primary control circuitry 402 is preferably made up of NPN transistors 416, 418, and 420 connected as a current mirror. Secondary control transistor 406 is preferably a PNP transistor. And, secondary control circuitry 408 is preferably made up of NPN transistors 422 and 424 connected as a current mirror.

Although primary control circuitry 402, secondary control transistor 406, and secondary control circuitry 408 are illustrated as being formed from PNP transistor 312 and NPN transistors 416, 418, 420, 422, and 424, other polarity bipolar junction transistors and other types of transistors, such as MOSFETs and CMOS devices, may be used in addition to or instead of these components.

During operation, output stages 302 and 304 of circuit 400 provide power to output terminal 326 as regulated by error amplifier 328. Unlike circuit 300 of FIG. 3, however, the selection of primary output stage 302 or secondary output stage 304 for providing power to output terminal 326 is controlled by saturation detection circuitry 306, primary control circuitry 402, and secondary control circuitry 408.

The lack of using error amplifier 314 to control the switching between power sources 322 and 324 eliminates the need to change the output of error amplifier 314 to effect a power source transition. Due to the slew rates in typical error amplifiers, this may be advantageous in many applications.

In normal operation, primary output stage 302 provides power to output terminal 326 as long as primary power source 322 has a high enough voltage to supply the required load current to output terminal 326. As long as primary output stage 302 stays in this state (i.e., not in dropout), transistor 338 of saturation detection circuitry 306 remains OFF. Consequently, transistors 416, 418, and 420 of primary control circuitry 402 also remain OFF because the current from saturation detection circuitry 306 is substantially zero. While transistor 418 remains OFF, none of the current provided by current source 310 to transistor 334 of primary output stage 302 is diverted away by primary control circuitry 402, and, therefore, primary output stage 302 remains responsive to regulatory signals from error amplifier 314 by way of transistor 312.

While transistor 420 also remains OFF, none of the current provided by current source 414 is diverted away from transistor 422 of secondary control circuitry 408. This causes transistor 424 of secondary control circuitry 408 to divert all of the current provided by current source 412 away from transistor 346 of secondary output stage 304, and, therefore, secondary output stage 304 to remain disabled, as long as the current conducted by the collector of transistor 424 (as determined by the size of current source 414 and the current ratio of the current mirror formed by transistors 422 and 424) exceeds the current provided by current source 412.

When primary output stage 302 enters dropout because the voltage provided by primary power source 322 drops below the dropout voltage, or when primary power source 322 is disconnected from primary output stage 302, transistor 332 begins to saturate and transistor 338 of saturation detection circuitry 306 begins to conduct current. Responsive to the current conducted by transistor 338 to transistor 416 of primary control circuitry 402, transistors 418 and 420 divert current provided respectively by current sources 310 and 414 away from transistors 334, 312, and 422. As current is diverted away from transistor 334 and 312, the current provided by primary output stage 302 is decreased, and primary output stage 302 is held at the edge of dropout as long as possible.

By maintaining primary output stage 302 at the edge of dropout, primary output stage 302 provides as much current as it can. As current is diverted away from transistor 422, transistor 424 ceases to divert all of the current away from transistor 346 of secondary output stage 304, and, consequently, secondary output stage 304 becomes responsive to regulatory signals from error amplifier 314 by way of transistor 406. In this backup mode of operation of circuit 400, secondary output stage 400 provides the required voltage and current from backup power source 324 on top of that provided by primary output stage 302 as required by output terminal 326.

When primary power source 322 can provide no more power, error amplifier 314 will regulate the power provided to output terminal 326 completely with secondary output stage 304. Transistor 338 of saturation detection circuitry 306 continues to conduct current, pulling the necessary current from secondary output stage 304 as primary output stage 302 no longer provides current, so that transistors 418 and 420 of primary control circuitry 402 continue to divert current produced by current sources 310 and 414 away from transistors 334 and 422.

An additional feature of the present invention that is present in circuit 400, but not in circuit 300 of FIG. 3, is that circuit 400 does not drive both output stages 302 and 304 ON simultaneously when output terminal 326 is shorted to ground 328. More particularly, when output terminal 326 is shorted to ground 328, secondary output stage 304 becomes disabled. As long as output terminal 326 is grounded, transistor 338 of primary detection circuitry 306 is reversed bias. This prevents current from flowing in transistors 416, 418, and 420, and, consequently, prevents transistors 418 and 420 from diverting current from transistor 335 and 422. Because no current is diverted away from transistor 422, all of the current to transistor 340 is diverted by transistor 424, and, therefore, secondary output stage 304 is disabled.

Persons skilled in the art will thus appreciate that the present invention can be practiced by other than the described embodiments, which are presented for purposes of illustration and not of limitation, and the present invention is limited only by the claims which follow.

What is claimed is:

1. A voltage regulator circuit that switches between a primary power source and a backup power source and provides a regulated output voltage at an output terminal, said regulator circuit comprising:

a primary output stage, coupled to said primary power source, capable of providing power to said output terminal;

a secondary output stage, coupled to said backup power source, capable of providing power to said output terminal;

selection circuitry responsive to said output voltage at said output terminal that selects at least one of said primary output stage and said secondary output stage to provide power to said output terminal;

a saturation detection circuit that detects dropout in said primary output stage; and a primary control circuit that causes said primary output stage to be held at the edge of dropout when said saturation detection circuit detects dropout in said primary output stage.

2. The voltage regulator circuit of claim 1, wherein said saturation detection circuit comprises a PNP transistor.

3. The voltage regulator circuit of claim 1, wherein said primary control circuit comprises a current mirror.

4. A voltage regulator circuit that switches between a primary power source and a backup power source and provides a regulated output voltage at an output terminal, said regulator circuit comprising:

a primary output stage, capable of being coupled to said primary power source and capable of providing power to said output terminal;

a secondary output stage, coupled to said backup power source, capable of providing power to said output terminal;

control circuitry that detects when said primary output stage is in dropout and that selects said secondary output stage to provide power to said output terminal when said primary output stage is in dropout, wherein said control circuitry comprises:

a saturation detection circuit that detects dropout in said primary output stage;

a primary control circuit that causes said primary output stage to be held at the edge of dropout when said saturation detection circuit detects dropout in said primary output stage; and a secondary control circuit that causes said secondary output stage to provide power to said output terminal.

5. The voltage regulator circuit of claim 4, wherein said primary control circuit comprises a current mirror.

6. The voltage regulator circuit of claim 4, wherein said secondary control circuit comprises a current mirror.

7. A voltage regulator circuit that switches between a primary power source and a backup power source and provides a regulated output voltage at an output terminal, said regulator circuit comprising:

a primary output stage, capable of being coupled to said primary power source and capable of providing power to said output terminal;

a secondary output stage, coupled to said backup power source, capable of providing power to said output terminal; and control circuitry that detects when said primary output stage is in dropout and that selects said secondary output stage to provide power to said output terminal when said primary output stage is in dropout, wherein said control circuitry further detects when said primary power source is decoupled from said primary output stage and selects said secondary output stage to provide power to said output terminal when said primary power source is decoupled from said primary output stage.

8. A method for switching between a primary power source and a backup power source and regulating an output voltage at an output terminal, comprising:

receiving power from said primary power source in a primary output stage that is capable of providing power to said output terminal;

receiving power from said backup power source in a secondary output stage that is capable of providing power to said output terminal;

selecting at least one of said primary output stage and said secondary output stage to provide power to said output terminal using selection circuitry in response to said voltage at said output terminal;

detecting dropout in said primary output stage; and causing said primary output stage to be held at the edge of dropout when dropout in said primary output stage is detected, wherein detecting dropout is accomplished by a saturation detection circuit that comprises a PNP transistor.

9. A method for switching between a primary power source and a backup power source and regulating an output voltage at an output terminal, comprising:

receiving power from said primary power source in a primary output stage that is capable of providing power to said output terminal;

receiving power from said backup power source in a secondary output stage that is capable of providing power to said output terminal;

selecting at least one of said primary output stage and said secondary output stage to provide power to said output terminal using selection circuitry in response to said voltage at said output terminal;

detecting dropout in said primary output stage; and causing said primary output stage to be held at the edge of dropout when dropout in said primary output stage is detected, wherein causing said primary output stage to be held at the edge of dropout is accomplished by a primary control circuit that comprises a current mirror.

10. A method for switching between a primary power source and a backup power source and regulating an output voltage at an output terminal, comprising:

receiving power from said primary power source in a primary output stage that is capable of providing power to said output terminal;

receiving power from said backup power source in a secondary output stage that is capable of providing power to said output terminal; and selecting at least one of said primary output stage and said secondary output stage to provide power to said output terminal using selection circuitry in response to said voltage at said output terminal, wherein said primary output stage comprises a PNP transistor and a Darlington connected transistor pair.

11. A method for switching between a primary power source and a backup power source and regulating an output voltage at an output terminal, comprising:

receiving power from said primary power source in a primary output stage that is capable of providing power to said output terminal;

receiving power from said backup power source in a secondary output stage that is capable of providing power to said output terminal; and selecting at least one of said primary output stage and said secondary output stage to provide power to said output terminal using selection circuitry in response to said voltage at said output terminal, wherein said secondary output stage comprises a PNP transistor and a Darlington connected transistor pair.

12. A method for switching between a primary power source and a backup power source and regulating an output voltage at an output terminal, comprising:

receiving power from said primary power source in a primary output stage that is capable of providing power to said output terminal;

receiving power from said backup power source in a secondary output stage that is capable of providing power to said output terminal; and detecting when said primary output stage is in dropout and selecting said secondary output stage to provide power to said output terminal when said primary output stage is in dropout, wherein control circuitry detects when said primary output stage is in dropout, said control circuitry comprising:

saturation detection circuitry that detects dropout in said primary output stage;

primary control circuitry that causes said primary output stage to be held at the edge of dropout when said saturation detection circuitry detects dropout in said primary output stage; and secondary control circuitry that causes said secondary output stage to provide power to said output terminal.

13. The method of claim 12, wherein said saturation detection circuitry comprises a PNP transistor.

14. The method of claim 12, wherein said primary control circuitry comprises a current mirror.

15. The method of claim 12, wherein said secondary control circuitry comprises a current mirror.

16. A voltage regulator circuit that controls power provided by a primary power source and a backup power source and that provides a regulated output voltage at an output terminal, said regulator circuit comprising:

a primary voltage regulator output stage that is coupled to said primary power source and to said output terminal, and that provides primary power from said primary power source to said output terminal;

a secondary voltage regulator output stage that is coupled to said backup power source and to said output terminal, and that provides backup power from said backup power source to said output terminal under the control of a control connection of said secondary voltage regulator output stage; and selection and regulation circuitry that is coupled to said output terminal and said control connection of said secondary voltage regulator output stage, that detects when said primary voltage regulator output stage is in dropout based upon a characteristic of said primary power provided to said output terminal, that selects said secondary voltage regulator output stage, through said control connection of said secondary voltage regulator output stage, to provide said backup power to said output terminal when said primary voltage regulator output stage is detected to be in dropout, and that provides a regulation signal that is coupled to both said primary voltage regulator output stage and said secondary voltage regulator output stage.

17. The voltage regulator circuit of claim 16, wherein said selection and regulation circuitry comprises an error amplifier that has an input that is coupled to said output terminal and an output that is coupled to said control connection of said secondary voltage regulator output stage.

18. The voltage regulator circuit of claim 16, further comprising:

a saturation detection circuit that detects dropout in said primary voltage regulator output stage; and a primary control circuit that causes said primary voltage regulator output stage to be held at the edge of dropout when said saturation detection circuit detects dropout in said primary voltage regulator output stage.

19. The voltage regulator circuit of claim 18, wherein said saturation detection circuit comprises a PNP transistor.

20. The voltage regulator circuit of claim 18, wherein said primary control circuit comprises a current mirror.

21. The voltage regulator circuit of claim 16, wherein said primary voltage regulator output stage comprises a PNP transistor and a Darlington connected transistor pair.

22. The voltage regulator circuit of claim 16, wherein said secondary voltage regulator output stage comprises a PNP transistor and a Darlington connected transistor pair.

23. The voltage regulator circuit of claim 16, wherein said primary voltage regulator output stage comprises a control connection that is coupled to said selection and regulation circuitry.

24. The voltage regulator circuit of claim 16, comprising an error amplifier that regulates said primary power provided by said primary voltage regulator output stage and said backup power provided by said secondary voltage regulator output stage.

25. The voltage regulator circuit of claim 24, comprising a control transistor that controls said primary voltage regulator output stage in response to said error amplifier.

26. The voltage regulator circuit of claim 24, comprising a secondary control transistor that controls said secondary voltage regulator output stage in response to said error amplifier.

27. The voltage regulator circuit of claim 16, wherein said selection and regulation circuitry comprises:

a saturation detection circuit that detects dropout in said primary voltage regulator output stage;

a primary control circuit that causes said primary voltage regulator output stage to be held at the edge of dropout when said saturation detection circuit detects dropout in said primary voltage regulator output stage; and a secondary control circuit that causes said secondary voltage regulator output stage to provide said backup power to said output terminal.

28. The voltage regulator circuit of claim 27, wherein said primary control circuit comprises a current mirror.

29. The voltage regulator circuit of claim 27, wherein said secondary control circuit comprises a current mirror.

30. The voltage regulator circuit of claim 27, wherein said saturation detection circuit comprises a PNP transistor.

31. The voltage regulator circuit of claim 27 wherein said saturation detection circuit, said primary control circuit, and said secondary control circuit cause said secondary voltage regulator output stage to not provide said backup power to said output terminal when said output terminal is shorted to a voltage level.

32. The voltage regulator circuit of claim 16, wherein said selection and regulation circuitry further detects when said primary power source is decoupled from said primary voltage regulator output stage and selects said secondary voltage regulator output stage to provide power to said output terminal when said primary power source is decoupled from said primary voltage regulator output stage.

33. The voltage regulator circuit of claim 16, wherein said characteristic is the voltage of said primary power provided to said output terminal.

34. A method for controlling power provided by a primary power source and a backup power source and regulating an output voltage at an output terminal, comprising:

providing primary power from said primary power source using a primary voltage regulator output stage to said output terminal;

providing a regulation signal to both said primary voltage regulator output stage and a secondary voltage regulator output stage;

detecting when said primary voltage regulator output stage is in dropout based upon a characteristic of said primary power provided to said output terminal; and selecting said secondary voltage regulator output stage to provide backup power from said backup power source to said output terminal when said primary voltage regulator output stage is detected to be in dropout.

35. The method of claim 34, further comprising:

causing said primary voltage regulator output stage to be held at the edge of dropout when dropout in said primary voltage regulator output stage is detected.

36. The method of claim 35, further comprising detecting dropout by detecting saturation in a transistor of said primary voltage regulator output stage.

37. The method of claim 35, wherein causing said primary voltage regulator output stage to be held at the edge of dropout is accomplished by controlling a control input of said primary voltage regulator output stage.

38. The method of claim 34, wherein said primary voltage regulator output stage regulates said primary power provided to said output terminal by controlling current flowing from said primary power source to said output terminal.

39. The method of claim 34, wherein said secondary voltage regulator output stage regulates said backup power provided to said output terminal by controlling current flowing from said backup power source to said output terminal.

40. The method of claim 34, comprising regulating said power provided by said primary voltage regulator output stage by measuring the voltage at said output terminal and providing said regulation signal based on the voltage measured at said primary voltage regulator output terminal.

41. The method of claim 40, wherein said regulating is accomplished using an error amplifier.

42. The method of claim 41, comprising:

controlling said primary voltage regulator output stage in response to said error amplifier using a control transistor.

43. The method of claim 41, comprising:

controlling said secondary voltage regulator output stage in response to said error amplifier using a secondary control transistor.

44. The method of claim 34, further comprising:

detecting when said primary voltage regulator output stage is decoupled from said primary power source; and selecting said secondary voltage regulator output stage to provide said backup power to said output terminal using selection circuitry when said primary voltage regulator output stage is decoupled from said primary power source.

45. The method of claim 34 further comprising causing said secondary voltage regulator output stage to not provide said backup power to said output terminal when said output terminal is shorted to a voltage level.

46. The method of claim 34, wherein said characteristic is the voltage of said primary power provided to said output terminal.

47. A voltage regulator circuit that controls power provided by a primary power source and a backup power source and that provides a regulated output voltage at an output terminal, said regulator circuit comprising:

a primary voltage regulator output stage that is coupled to said primary power source, that is coupled to said output terminal, and that has a control connection that controls said primary voltage regulator output stage;

a secondary voltage regulator output stage that is coupled to said backup power source, that is coupled to said output terminal, and that has a control connection that controls said secondary voltage regulator output stage;

a control transistor that is coupled to said control connection of said primary voltage regulator output stage; and an error amplifier that is coupled to said output terminal, said control transistor, and said control connection of said secondary voltage regulator output stage, so that said error amplifier, in response to a voltage at said output terminal, drives said control transistor, causing said control transistor to control said primary voltage regulator output stage through said control connection of said primary voltage regulator output stage, and said control connection of said secondary voltage regulator output stage, causing said secondary voltage regulator output stage to provide power to said output terminal when said primary voltage regulator output stage is in dropout.

48. The voltage regulator circuit of claim 47, further comprising:

a saturation detection circuit that detects saturation in said primary voltage regulator output stage; and a current mirror coupled to said saturation detection circuit and said control connection of said primary voltage regulator output stage that, in conjunction with said saturation detection circuit, causes said primary voltage regulator output stage to be held at the edge of dropout.

49. The voltage regulator circuit of claim 48, wherein said saturation detection circuit comprises a PNP transistor.

50. The voltage regulator circuit of claim 48, wherein said current mirror is formed from two NPN transistors.

51. The voltage regulator circuit of claim 47 wherein said primary voltage regulator output stage comprises a PNP transistor, having an emitter coupled to said primary power source and having a base, and a Darlington connected transistor pair, having a collector coupled to said base of said PNP transistor and having a base coupled to said control connection of said primary voltage regulator output stage.

52. The voltage regulator circuit of claim 47 wherein said secondary voltage regulator output stage comprises a PNP transistor, having an emitter coupled to said backup power source and having a base, and a Darlington connected transistor pair, having a collector coupled to said base of said PNP transistor and having a base coupled to said control connection of said secondary voltage regulator output stage.

53. A voltage regulator circuit that controls power provided by a primary power source and a backup power source and that provides a regulated output voltage at an output terminal, said regulator circuit comprising:

a primary voltage regulator output stage that is coupled to said primary power source, that is coupled to said output terminal, and that has a control connection that controls said primary voltage regulator output stage;

a secondary voltage regulator output stage that is coupled to said backup power source, that is coupled to said output terminal, and that has a control connection that controls said secondary voltage regulator output stage;

a primary control transistor that is coupled to said control connection of said primary voltage regulator output stage;

a secondary control transistor that is coupled to said control connection of said secondary voltage regulator output stage;

an error amplifier that is coupled to said output terminal, said primary control transistor, and said secondary control transistor, so that said error amplifier, in response to a voltage at said output terminal, drives said primary control transistor, causing said primary control transistor to control said primary voltage regulator output stage through said control connection of said primary voltage regulator output stage, and said secondary control transistor, causing said secondary control transistor to control said secondary voltage regulator output stage through said control connection of said secondary voltage regulator output stage;

a saturation detection circuit that detects saturation in said primary voltage regulator output stage;

a primary current mirror coupled to said saturation detection circuit and said control connection of said primary voltage regulator output stage that, in conjunction with said saturation detection circuit, causes said primary voltage regulator output stage to be held at the edge of dropout; and a secondary current mirror coupled to said primary current mirror and said control connection of said secondary voltage regulator output stage that, in conjunction with said saturation detection circuit and said primary current mirror, causes said secondary voltage regulator output stage to provide power to said output terminal when said primary voltage regulator output stage is in dropout.

54. The voltage regulator circuit of claim 53, wherein said saturation detection circuit comprises a PNP transistor.

55. The voltage regulator circuit of claim 53, wherein said primary current mirror is formed from three NPN transistors.

56. The voltage regulator circuit of claim 53, wherein said secondary current mirror is formed from two NPN transistors.

57. The voltage regulator circuit of claim 53 wherein said primary voltage regulator output stage comprises a PNP transistor, having an emitter coupled to said primary power source and having a base, and a Darlington connected transistor pair, having a collector coupled to said base of said PNP transistor and having a base coupled to said control connection of said primary voltage regulator output stage.

58. The voltage regulator circuit of claim 53 wherein said secondary voltage regulator output stage comprises a PNP transistor, having an emitter coupled to said backup power source and having a base, and a Darlington connected transistor pair, having a collector coupled to said base of said PNP transistor and having a base coupled to said control connection of said secondary voltage regulator output stage.

59. The voltage regulator circuit of claim 53 wherein said saturation detection circuit, said primary current mirror, and said secondary current mirror cause said secondary voltage regulator output stage to not provide power to said output terminal when said output terminal is shorted to a voltage level.

* * * * *

UNITED STATES PATENT AND TRADEMARK OFFICE

CERTIFICATE OF CORRECTION

PATENT NO. : 6,097,178
DATED : August 1, 2000
INVENTOR(S) : Owen et al.

It is certified that error appears in the above-identified patent and that said Letters Patent is hereby corrected as shown below:

Column 2,
Line 50, change "single-out" to -- single-output --.

Column 8,
Line 28, change "312" to -- 406 --.
Line 35, change "328" to -- 314 --.
Lines 39-40, close up text (no new paragraph).

Column 9,
Line 27, change "400" to -- 304 --.
Line 51, change "335" to -- 334 --.
Line 53, change "340" to -- 346 --.

Signed and Sealed this

Twenty-first Day of June, 2005

JON W. DUDAS
*Director of the United States Patent and Trademark Office*